US005289245A

United States Patent [19]

Menjo

[11] Patent Number: 5,289,245

[45] Date of Patent: Feb. 22, 1994

[54] RECORDING MATERIAL FOR USE IN AN IMAGE FORMING APPARATUS IN WHICH A POWDER TONER IMAGE IS FORMED ON THE RECORDING MATERIAL AND THEN FIXED BY THE APPLICATION OF HEAT AND PRESSURE

[75] Inventor: Takeshi Menjo, Tokyo, Japan

[73] Assignee: Canon Kabushiki Kaisha, Tokyo, Japan

[21] Appl. No.: 73,627

[22] Filed: Jun. 8, 1993

Related U.S. Application Data

[63] Continuation of Ser. No. 837,924, Feb. 20, 1992, abandoned.

[30] Foreign Application Priority Data

Feb. 25, 1991 [JP] Japan ..... 3-030285

[51] Int. Cl.[5] ..... G03G 15/20

[52] U.S. Cl. ..... 355/284; 428/213; 428/447

[58] Field of Search ..... 355/282, 284, 285, 290, 355/295, 289; 428/213, 447, 514

[56] References Cited

U.S. PATENT DOCUMENTS

| | | | |
|---|---|---|---|
| 4,352,551 | 10/1982 | Iwao | 355/284 |
| 4,549,803 | 10/1985 | Ohno et al. | 355/284 |
| 4,565,762 | 1/1986 | Kato | 355/284 X |
| 4,642,247 | 2/1987 | Mouri et al. | 428/213 X |
| 4,877,678 | 10/1989 | Hasegawa et al. | 428/447 X |
| 5,049,943 | 9/1991 | Menjo et al. | 355/284 |

*Primary Examiner*—A. T. Grimley
*Assistant Examiner*—Sandra L. Brasé
*Attorney, Agent, or Firm*—Fitzpatrick, Cella, Harper & Scinto

[57] ABSTRACT

A recording material, particularly a resin film as a recording material, used in an image forming apparatus in which a toner image is formed on the recording material and then fixed thereto by applying at least pressure to the toner image using a fixing rotatable member coated with a releasing agent is disclosed. The recording material has a base layer, a first resin layer having compatibility with the toner used greater than with the base layer, and a second resin layer absorbing a releasing agent. Alternately, a resin layer provided on the base layer, the resin layer having compatibility with the toner greater than with the base layer and containing a releasing agent absorbing substance.

19 Claims, 7 Drawing Sheets

RECORDING MATERIAL FOR USE IN AN IMAGE FORMING APPARATUS IN WHICH A POWDER TONER IMAGE IS FORMED ON THE RECORDING MATERIAL AND THEN FIXED BY THE APPLICATION OF HEAT AND PRESSURE

This application is a continuation of application Ser. No. 07/837,924 filed Feb. 20, 1992, now abandoned.

BACKGROUND OF THE INVENTION

1. Field of the Invention

The present invention relates to a recording material for an image forming apparatus such as a copying machine, a printer or the like, particularly an image forming apparatus having a fixing roller which is coated with a releasing agent.

2. Description of the Related Art

Fixing devices widely used for image forming apparatuses include devices of a roller fixing type, particularly a heat roller fixing type, in which a toner image on a recording material is fixed by conveying the recording material between two rollers.

Typical recording materials include paper. However, resin films such as transparency films and the like are increasingly being used as recording materials.

Further, a heated roller type of fixing device is coated with a releasing agent such as silicone oil or the like in order to prevent offset of the toner used.

In a full-color image forming apparatus in which toner is applied in layers, a large amount of silicone oil is coated on a fixing device because the toner easily offsets.

When a toner image on a resin film is fixed by such a fixing roller which is coated with silicone oil, there is the problem that the oil wets the resin film which then has a sticky feeling after fixing.

The sticky feeling is caused by oil which is not absorbed by the resin film and thus remains on the film surface. However, when a recording material is made of paper, the paper material does not have the above sticky feeling because the coated oil is absorbed by the paper due to the oil absorptivity of paper.

In addition, when a full-color image is formed on such a resin film and is used as a projected image by an OHP apparatus, the projected image contains components showing an overall gray tone in spite of the satisfactory color development shown by the image on the film, and the range of color reproduction is significantly narrowed. This is caused by the phenomenon that since the toner formed on the smooth transparent film is caused to insufficiently flow to form grains by heating during fixing, the incident light is scattered and thus forms shadow on a screen during projection of the image. Particularly, in a portion having a low image density and an intermediate tone, since a decrease in number of toner grains causes the absorption level of the dye or pigment contained in the toner to be decreased to the same level as that of black absorption caused by the light scattered by the toner grains, a color tone to be reproduced is grayed.

In addition, when an image is formed on paper, since a difference occurs between the non-glossiness of the paper surface and the glossiness of the portion where the toner image is formed, uniform glossiness within the paper, which is desirable for a color image, disappears. This causes the problem that a desirable image having good colors is not formed.

SUMMARY OF THE INVENTION

It is an object of the present invention to provide a recording material which does not become sticky when a releasing agent is applied.

It is another object of the present invention to provide a resin film which enables an image to be projected by an OHP apparatus with excellent color reproduction.

It is still another object of the present invention to provide a recording material having a resin layer which absorbs a releasing agent.

It is a further object of the present invention to provide a recording material having a base layer and a resin layer which has higher compatibility with a toner than does the base layer and which contains a substance absorbing a releasing agent.

In accordance with the above objects, there is provided in one aspect a recording material for use in an image forming apparatus in which a toner image of toner having a given solubility is formed on a recording material and then fixed by application of at least pressure from a fixing rotatable member that is coated with a releasing agent, the recording material comprising a base layer, a first resin layer provided on the base layer and having a compatibility with the base layer and a second resin layer provided on the first resin layer for absorbing the releasing agent.

In another aspect of the invention, there is provided a recording material for use in an image forming apparatus in which a toner image of toner having a given solubility is formed on a recording material an then fixed by application of at least pressure from a fixing rotatable member that is coated with a releasing agent, the recording material comprising a base layer, a first resin layer having compatibility of solubility with the toner greater than with the base layer and a second resin layer for absorbing the releasing material, wherein the second resin layer is provided on the base layer and the first resin layer is provided on the second resin layer.

In still yet another aspect of the invention, there is provided a recording material for use in an image forming apparatus in which a toner image of toner having a given solubility is formed on a recording material and then fixed by application of at least pressure from a fixing rotatable member that is coated with a releasing agent, the recording material comprising a base layer and a resin layer having compatibility of solubility with the toner greater than with the base layer and containing a releasing agent absorbing substance.

Other objects of the invention will be apparent from the description below.

DESCRIPTION OF PREFERRED EMBODIMENTS

Embodiments of the present invention are described below.

Figure 1:
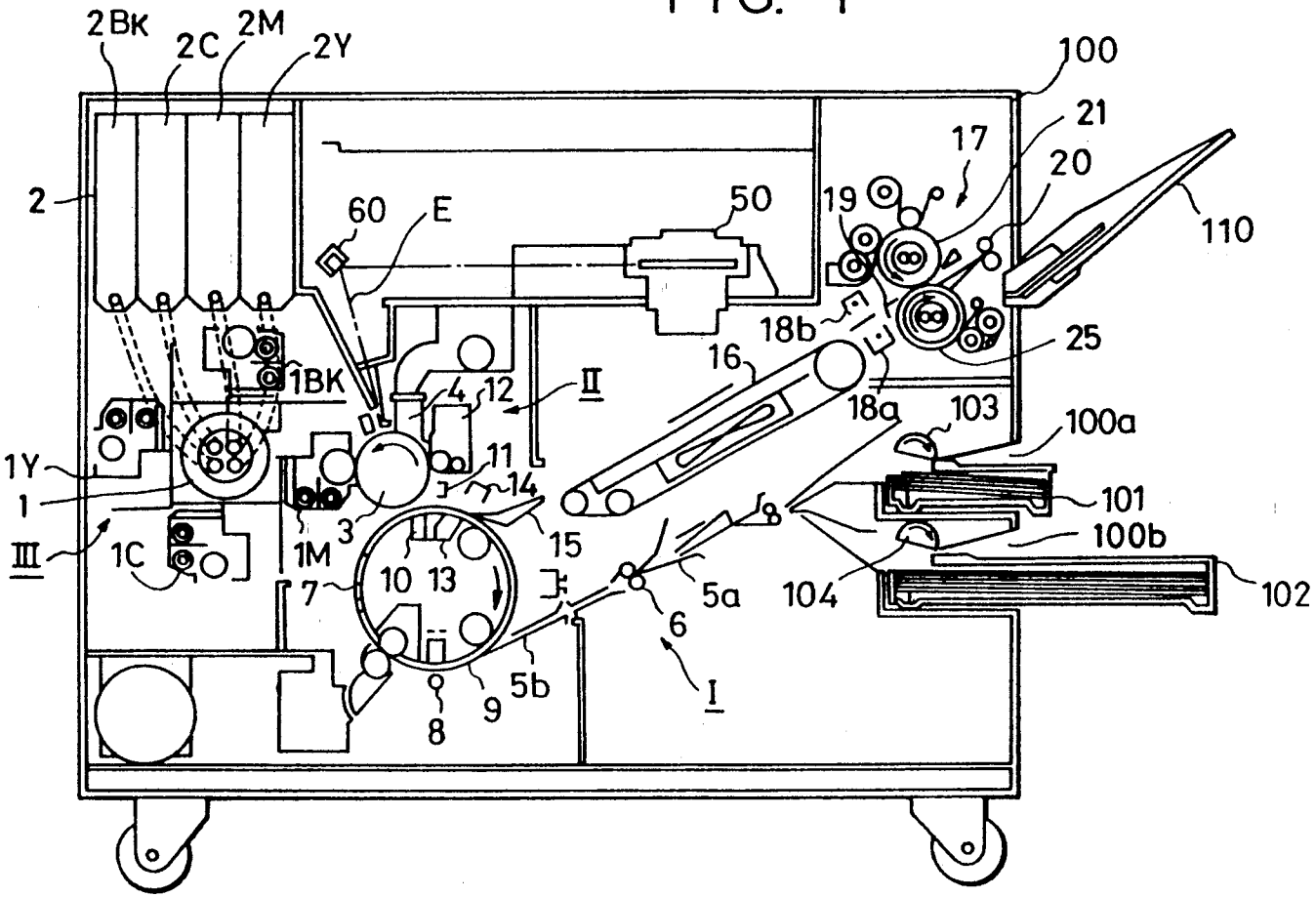
FIG. 1 is a sectional view of an image forming apparatus which uses a recording material according to an embodiment of the present invention.

FIG. 1 is a sectional view of an electrophotographic full-color image forming apparatus which is capable of forming a toner image on a resin sheet such as those forming the embodiments of the present invention.

The apparatus comprises a transfer material conveying system I provided from one side (the right side of FIG. 1) of an apparatus body 100 to a substantially central portion of the apparatus body 100, a latent image forming portion II provided in the substantially central portion of the apparatus body 100, a rotary developing device III, disposed near the latent image forming portion II, and developer supply means, i.e., a developer supply device 2, disposed near the rotary developing device III.

The transfer material conveying system I comprises transfer material supply trays 101, 102 which are detachably fitted in the openings 100*a*, 100*b* formed on one side (the right side shown in FIG. 1) of the apparatus body 100, paper feeding rollers 103, 104 disposed substantially directly above the trays 101, 102, respectively, paper feeding guides 5*a*, 5*b* disposed near the paper feeding rollers 103, 104 and provided with a paper feeding roller 6, a transfer drum 9 provided near the paper feeding guide 5*b* and being rotatable in the arrow direction shown in FIG. 1, a conveyor belt 16 provided near the separating claw 15, a discharge tray 110 provided near the end of the direction of conveyance of the conveyor belt 16, outwardly extended from the apparatus body 100 and detachable from the apparatus body 100, and a fixing device 17 provided near the discharge tray 110. The transfer drum 9 has a contact roller 8, a gripper 7, a transfer material separating charger 14 and a separating claw 15, all of which are disposed near the outer peripheral surface thereof in the direction of rotation from the upstream side to the downstream side thereof, and a transfer charger 10 and a transfer material separating charger 13, both of which are provided on the inner peripheral side of transfer drum 9.

The latent image forming portion II is provided with an image supporting member, i.e., photosensitive drum 3, disposed in contact with the outer peripheral surface of the transfer drum 9 and being rotatable in the direction shown by an arrow in FIG. 1, a destaticizing charger 11, a cleaning means 12 and a primary charger 4, which are disposed near the outer peripheral surface of the photosensitive drum 3, an image exposure means 50 such as a beam scanner or the like for forming an electrostatic latent image on the outer peripheral surface of the photosensitive drum 3, and image exposure reflection means 60 such as a laser beam generator.

The rotary developing device III has a rotatable rotor 1 and a magenta developing unit 1M, a cyan developing unit 1C, a yellow developing unit 1Y and a black developing unit 1BK, which are mounted on the rotor 1 so as to visualize (develop) the electrostatic latent image formed on the outer peripheral surface of the photosensitive drum 3 at a position opposing the outer peripheral surface of the photosensitive drum 3.

The developer supply device 2 is provided with a yellow hopper 2Y, a magenta hopper 2M, a cyan hopper 2C and a black hopper 2BK, which are disposed adjacent each other for respectively holding developers having the colors supplied from the outside.

The sequence of the whole image forming apparatus configured as described above is briefly described below with reference to the case of image formation in a full-color mode as an example.

When the photosensitive drum 3 is rotated in the direction of the arrow shown in FIG. 1, the photosensitive material of the photosensitive drum 3 is uniformly charged by the primary charger 4. When the photosensitive material is uniformly charged by the primary charger 4, an image is exposed to the laser beams E modulated by a magenta image signal of an original (not shown) to form an electrostatic latent image on the photosensitive drum 3. The electrostatic latent image is then developed by the magenta developing unit 1M which was previously moved to a development position by rotation of the rotor 1.

At about the same time, the transfer material which is conveyed through the paper feeding guide 5*a*, the paper feeding rollers 6, and the paper feed guide 5*b* is held by the griper 7 at a predetermined timing and electrostatically wound on the transfer drum 9 by the contact roller 8 and the electrode disposed opposite to the contact roller 8. The transfer drum 9 is rotated in the arrow direction shown in FIG. 1 synchronously with the photosensitive drum 3 so that the image developed by the magenta developing unit 1M is transferred by the transfer charger 10 at the position where the outer periphery of the photosensitive drum 3 contacts the transfer drum 9. The transfer drum 9 is continuously rotated for transfer of a next color (cyan in FIG. 1).

The photosensitive drum 3 is destaticized by the destaticizing charger 11, cleaned by the cleaning means 12 and then again charged by the primary charger 4 so that the image is exposed by the next cyan image signal in the same manner as that described above. The rotary developing unit III is rotated during the time an electrostatic latent image is formed on the photosensitive drum 3 by exposure on the basis of the cyan image signal so as to position the cyan developing unit 1C at the above-described development position for predetermined cyan development. The above-described process is successively performed for yellow and black colors. When transfer of the four colors is completed, the four-color developed image formed on the transfer material is destaticized by the chargers 13, 14. The holding of the transfer material by the griper 7 is then released, and the transfer material is separated from the transfer drum 9 by the separating claw 15 and sent to the conveyor belt 16.

The transfer material is then charged again by pre-fixing chargers 18a, 18b, guided to an inlet guide 19 and then sent to a portion between the fixing roller 21 and the pressure roller 25 (refer to FIG. 2) of the fixing device 17, which are described below, for heat and pressure fixing. The transfer material is finally discharged from the apparatus body 100 by paper discharging rollers 20 serving as paper discharging/guiding members.

When a series of full-color print sequence is completed, a required full-color print image is formed.

A description is now made of a toner used as a developer in the image forming apparatus.

In the formation of a full-color image, the range of color reproduction of a copy can be widened by using a sharp melting toner.

The toner is produced by melting and kneading toner forming materials including a binder resin such as a polyester resin, a styrene-acrylic ester resin or the like, a coloring agent (dye, sublimating dye), a charge controlling agent and so on, grinding the resultant mixture and then classifying the particles produced. If required, various additives (for example, hydrophobic colloidal silica) may be added in the addition step.

A color toner preferably contains as a binder resin a polyester resin in view of its fixing and sharp melting properties. Examples of sharp melting polyester resins include polymer compounds each of which is synthesized from a diol compound and a dicarboxylic acid and has ester bonds in the main chain of the molecule.

Polyester resins obtained by at least co-condensation polymerization of a bisphenol derivative or a substituted substance thereof used as a diol component and a polyvalent carboxylic acid, an acid anhydride thereof or a lower alkyl ester thereof used as a carboxylic acid component are preferable because they have sharp melting properties. Typical examples of bisphenol derivatives include compounds expressed by the following formula:

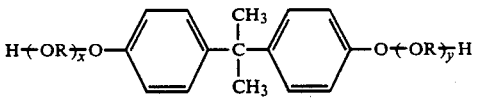

(wherein R is an ethylene or propylene group; x and y is each a positive integer of 1 or more; and the average of x+y is 2 to 10). Examples of carboxylic acids include fumaric acid, maleic acid, maleic anhydride, phthalic acid, terephthalic acid, trimellitic acid, pyromellitic acid and the like.

Figure 3:
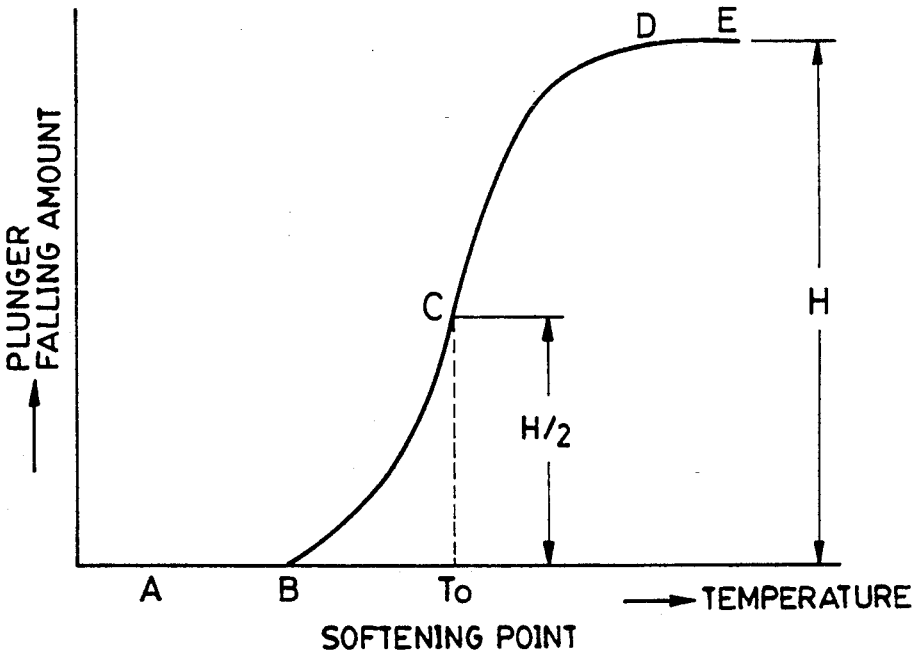
FIG. 3 is a graph explaining the characteristics of the toner used in the apparatus shown in FIG. 1.

The polyester resin used has a softening point of 75° to 150° C., and preferably 80 to 120° C. FIG. 3 shows the softening characteristics of a toner containing as the binder resin a polyester resin. The method of measuring the softening point in the present invention is described below.

A plunger falling amount-temperature curve (referred to as "softening S-curve" hereinafter) is obtained by heating at a constant rate of 6° C./minute after preheating for a time of 300 seconds at an initial set temperature 70° C. while applying an extrusion load of 20 Kg using a die (nozzle) having a diameter of 0.2 mm and a thickness of 1.0 mm in a flow tester CFT-500A (manufactured by Shimadzu Corp.). 1 to 3 g of fine powder of a toner sample is precisely weighed and used, and the sectional area of the plunger used is 10 $cm^2$. FIG. 3 shows the softening S-curve obtained. The toner is gradually heated and started to flow out of the nozzle (the plunger falls A→B), with heating at a constant rate. When the toner is further heated, the molten toner mostly flows (B→C→D), and the plunger falling is stopped (D→E).

The height H of the S-curve shows the total flow, and the temperature $T_0$ corresponding to the point H/2C shows the softening point of the sample (for example, the toner or resin).

Whether or not the toner or binder resin has sharp melting properties can be decided by measuring the apparent melt viscosity of the toner or binder resin.

In the present invention, if the temperature at which the apparent melt viscosity of a toner or binder resin having sharp melting properties is 103 poise is $T_1$, and if the temperature at which the apparent melt viscosity is $5\times10^2$ poise is $T_2$, the toner or binder satisfies the following conditions:

$T_1=90°$ to 150° C.

$$|\Delta T|=|T_1-T_2|=5° \text{ to } 20° \text{ C.}$$

The sharp melting resin having such temperature-melt viscosity characteristics is characterized in that the viscosity is sharply decreased by heating. Such a decrease in viscosity causes appropriate mixing of the uppermost toner layer and the lowermost toner layer and rapidly increases the transparency of the toner layer itself, thereby producing good subtractive color mixing.

A color toner having such sharp melting properties has large affinity and is easily offset during fixing.

The fixing device 17 is described in detail below with reference to FIG. 2.

Figure 2:
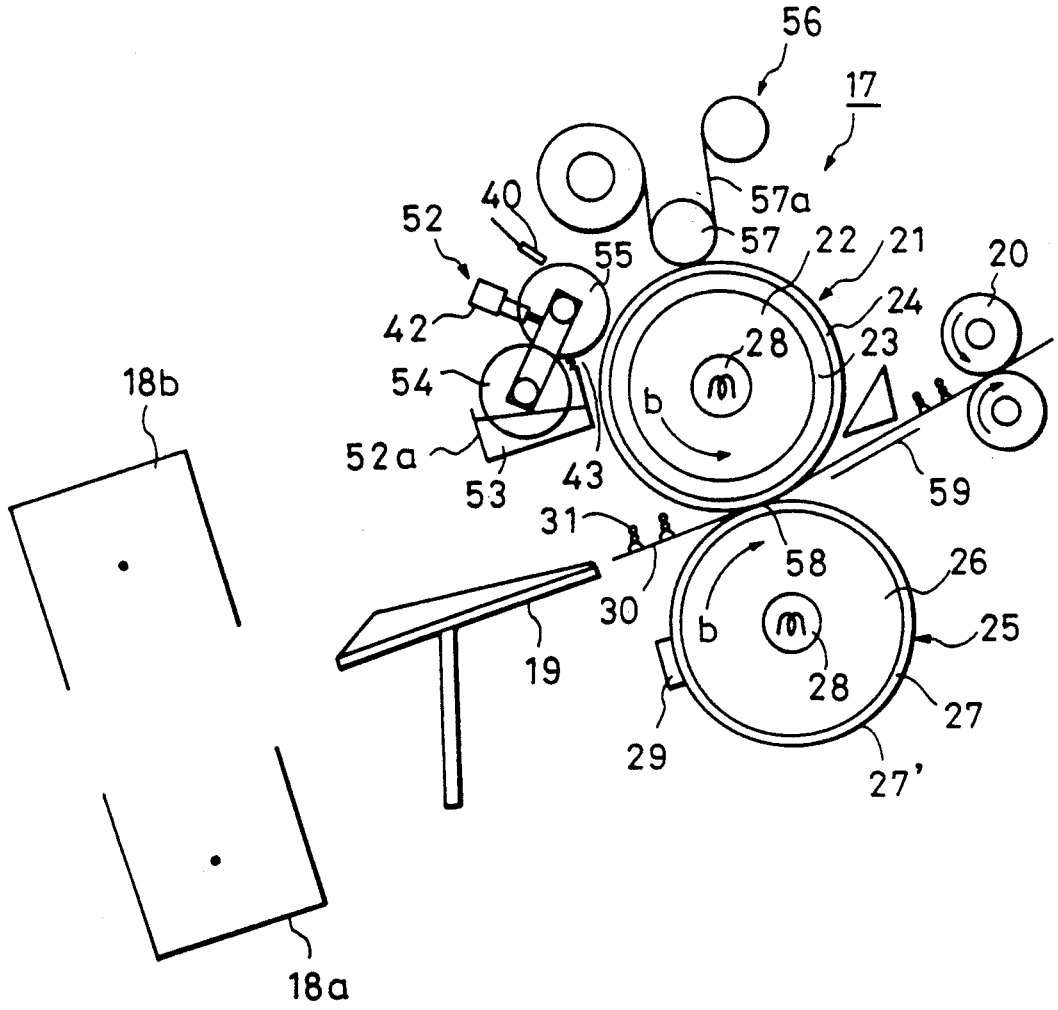
FIG. 2 is an enlarged sectional view of the fixing device used in the apparatus shown in FIG. 1.

In FIG. 2, reference numeral 21 denotes a fixing roller comprising an aluminum metal core 22, a middle layer 23 of HTv silicone rubber (high-temperature vulcanized silicone rubber) which is coated to a predetermined thickness on the core 22, and an external layer 24 of LTV silicone rubber (low-temperature vulcanized silicone rubber) which is coated to a thickness of 200 μm on the middle layer 23, the total thickness of the rubber layers being 3 mm. A pressure roller 25 is provided below the fixing roller 21. The pressure roller 25 comprises an aluminum metal core 26, an external layer 27 of HTV silicone rubber which is coated to a thickness of 1 mm on the core 26, and a resin film 27' coated on the surface of the external layer 27. A halogen heater 28 of 400 W is disposed as a heating source in each of the fixing roller 21 and the pressure roller 25. A thermistor 29 contacts the pressure roller 25 so as to control ON/OFF of supply of current to the halogen heaters 28. This structure causes the surface temperatures of the fixing roller 21 and the pressure roller 25 to be kept at a predetermined value (for example, 170° C.) suitable for fixing an unfixed toner image 31 on the transfer material 30 to the transfer material 30. Each of the fixing roller 21 and the pressure roller 25 is rotated in the arrow direction b shown in FIG. 2 by a driving device (not shown).

A releasing agent applying unit 52 is provided at a predetermined position in the fixing device 17 so as to improve release of the toner from the fixing roller 21. In the releasing agent coating unit 52, silicone oil 53 (dimethylsilicone oil KF96 300CS produced by Shin-etsu Chemical) contained in an oil tank 52a is drawn up by roller groups 54, 55, controlled to a predetermined amount by a coating amount adjusting blade 40 and then coated on the fixing roller 21.

The coating roller 55 is brought into contact with and separated from the fixing roller 21 by a plunger 42 and a spring 43.

The coating amount of silicone oil is generally determined by the following method:

Assuming that the weight of 50 sheets of A4-size transfer materials (white paper) is $A_1$ g., the weight of 50 Sheets of transfer materials (white paper) to which no image is transferred and which are passed between the fixing roller and the pressure roller without the silicone oil being coated is B g., the weight of 50 sheets of other A4-size transfer materials (white paper) is $A_2$ g., and the weight of 50 sheets of the transfer materials (white paper) to which no image is transferred and which are passed between the fixing roller and the pressure roller with the silicone oil being coated on the offset preventing layer of the fixing roller is C g. The amount x g. of the silicone oil coated on a single sheet of A4-size transfer material (white paper) is determined by the following equation:

$$x=(C+A_1-B-A_2)/50$$

In the fixing device, since the above-described sharp melting color toner which is easily offset is fixed and released, the amount x of the releasing agent coated is about 0.1 g.

Particularly, in the case of a fixing device in a color image forming apparatus, offset easily occurs because a plurality of toner layers of colors M, C, Y, BK are formed on a transfer material.

In the fixing device 17, the roller 55 contacts with the fixing roller 21 so as to coat the releasing agent on the fixing roller 21 up to the portion of contact between the fixing roller 21 and the pressure roller 25, i.e., a nip portion 58, by rotation of the fixing roller 21. The timing of coating of the releasing agent on the fixing roller 21 is controlled so that the leading end of the releasing agent coated on the fixing roller 21 reaches the nip before the transfer material 30 enters the nip.

Further, a cleaning unit 56 is provided at a predetermined position of the fixing device 17 so as to remove the toner offset on the fixing roller 21. The cleaning unit 56 comprises a cleaning web **57*a* which is put into contact with the fixing roller 21 by a pressure roller 57 so as to clean the fixing roller 21**.

The transfer material 30 to which the toner image 31 is transferred is sent to the conveyor belt 16 (shown in FIG. 1) and then passes through the pre-fixing chargers **18*a*, 18*b*. In the pre-fixing chargers 18*a*, 18*b*, the transfer material 30 is charged with the same polarity (positive) as that of the transfer charger 10 (shown in FIG. 1) by the charger 18*a*, and is charged with the polarity (negative) opposite to that of the charger 18*a* by the charger 18*b*. As a result, the transfer material 30 and the toner image 31** are charged again.

The transfer material 30 is then passed through the inlet guide 19 and enters the nip 58 between the fixing roller 21 and the pressure roller 25 where the toner image 31 is fixed to the transfer material 30 by virtue of the heat and pressure which are applied by the fixing roller 21 and the pressure roller 25.

The transfer material 30 is then guided by the paper discharging guide 59 and discharged to the outside of the apparatus by the paper discharging rollers 20 serving as paper discharging/guiding members.

Figure 4:
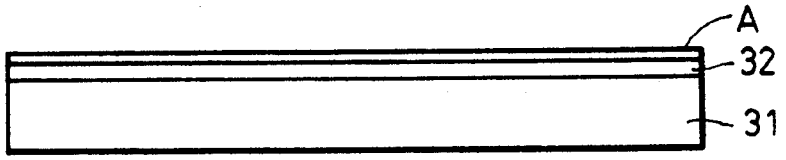
FIG. 4 is a sectional view of a recording material in accordance with an embodiment of the present invention.

FIG. 4 is a sectional view showing a transparent resin film in accordance with an embodiment of the present invention.

In FIG. 4, reference numeral 31 denotes a base film of the transparent film which comprises a transparent resin layer. The base film 31 is a heat resistant resin film which is resistant to thermal deformation by heating during fixing and which shows a maximum use temperature of at least 100° C. Examples of such resin films include polyethylene terephthalate (PET) films, polyamide films, polyimide films and the like. Of these films, polyethylene terephthalate films are particularly preferable from the viewpoints of heat resistance and transparency. The base film 31 must have a thickness which does not cause the occurrence of shrinkage even when the film is softened by heating during fixing. The film made of any one of the above resin materials preferably has a thickness of at least 50 μm. In addition, since the transmittance of a transparent film is decreased as the thickness is increased, the thickness of the base film 31 is 200 μm or less, and preferably 150 μm or less.

Reference numeral 32 denotes a transparent resin layer serving as a topcoat layer for improving the light transmission of the color image fixed.

The topcoat layer 32 is selected to have excellent compatibility with the toner used, as compared with the base film 31.

It is preferable for increasing light transmission that the layer 32 is formed by using the same resin as that of a color image forming toner or a resin compatible with the toner resin and having a softening point temperature ($T_0$) which is defined by the point C on the softening S-curve obtained by the flow tester CET-500 (manufactured by Shimadzu Corp.) and which is different from the softening point defined by the same method as that for the toner by 40° C. or less, preferably 20° C. or less, and more preferably 10° C. or less. The resin of the layer 32 is preferably substantially mixed with the toner resin without forming any boundary due to its compatibility with the binder resin of the toner. The resin of the layer 32 may be selected on the basis of the criterion that a difference between the solubility parameter values of the resin of the layer 32 and the binder resin of the toner having a central value is within the range of ±1.5 or less, preferably ±1.0. The solubility parameter values of resins are described in a publication such as the Polymer Handbook. For example, when the above-described polyester resin is used as a binder resin of the toner, since the solubility parameter value of the polyester resin is about 11.0, a resin having a softening point difference of ±40° C. from that of the binder resin may be selected as a resin for the layer 32 from the group consisting of polyester resins, polymethylmethacrylate resins, epoxy resins, polyurethane resins, vinyl chloride resins, polyvinyl chloride-vinyl acetate copolymer resins, all of which have solubility parameter values within 11.5±1.5. The resin of the layer 32 preferably has the above-described softening point and sharp melting properties.

Although the thickness of the layer 32 depends upon the particle size of the toner, the layer 32 must have a thickness corresponding to at least half of the average particle size of the toner in order to cause sufficient light transmission of a low-density portion having a thickness corresponding to about one toner particle. However, if the thickness is a value corresponding to at least three times the toner particle size, the amount of molten resin is increased. This causes the occurrence of blurring or distortion in the image formed and the occurrence of cracks in the image. The thickness of the layer 32 is preferably ½ to 2 times the volume average particle size of the toner.

In the present invention, the average particle size of the toner is measured on the basis of the method below.

Coulter counter TA-II (manufacture by Coulter Co.) is connected to an interface (manufactured by Nikkaki Co.) and CX-1-personal computer (Canon Corp.) for outputting a number distribution, a volume distribution, a number average and a volume average. A 1%-NaCl aqueous solution is prepared as an electrolyte by using extrapure sodium chloride.

0.1 to 5 ml of surfactant, preferably alkylbensenesulfonate, is added as a dispersant to 100 to 150 ml of the electrolyte prepared, and 0.5 to 50 mg, preferably 2 to 20 mg, of measurement sample is then added thereto.

The electrolyte in which the sample is suspended is subjected to dispersion treatment using an ultrasonic disperser for about 1 to 3 minutes and then subjected to measurement of the particle size distribution of particles having a size of 2 to 40μ using the Coulter counter TA-II and an aperture of 100μ to obtain a volume average particle size.

Figure 9:
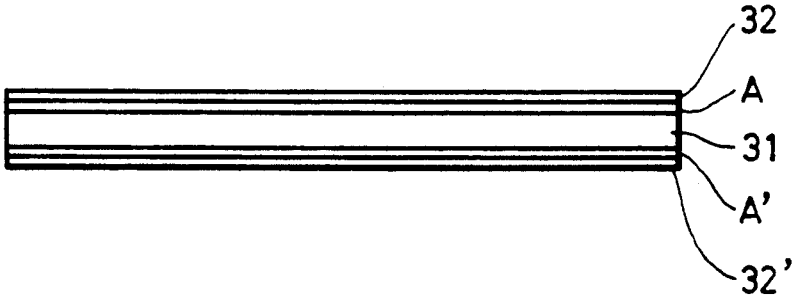
FIG. 9 is a sectional view of a recording material in accordance with another embodiment of the present invention.

A method of forming the resin film of the present invention comprises coating, on the transparent base film by a bar coating method, a dipping method, a spray method, a spin-coating method or the like, the solution obtained by dissolving a resin for forming the layer 32 in a volatile organic solvent. The solvent may be an alcohol such as methanol, ethanol or the like, or a ketone such as methyl ethyl ketone, acetone or the like. In some cases, an adhesive layer 33 (as shown in FIG. 9) which has compatibility with both the base film 31 and the topcoat layer 32 and high heat resistance and which does not melt during the fixing operation may be provided for improving the adhesion between the layer 32 and the base film 31 and for preventing the image from being separated during or after fixing. Examples of resins that can be used for the adhesive layer include ester resins, acrylate resins, methacrylate resins, styrene-acrylate copolymer resins and styrene-methacrylate copolymer resins.

The resin film according to the embodiment of the present invention is further described in detail below in the context of the following examples.

EXAMPLE 1

An acetone solution of sharp melting polyester resin (solubility parameter, about 11.0) having a softening point of 110° C. which was defined by the softening S-curve obtained by the flow tester CET-500 (manufacture by Shimadzu Corp.) was coated, by a bar coater method, on a heat-resistant polyethylene terephthalate film which was biaxially oriented and which had a thickness of 100 μm and a maximum use temperature of 150° C. A topcoat layer was then formed so that the thickness was 16 μm after drying to form a transparent resin film.

A releasing agent absorbing layer A is formed on the topcoat layer 32 so as to absorb and hold silicone oil.

The thickness of the releasing agent absorbing layer A is 6 μm which is smaller than the average particle size 10 μm of the toner.

The toner was thus sufficiently compatible with the topcoat layer 32. The releasing agent absorbing layer was formed by coating a mixture containing 90 parts of polyvinyl pyrrolidone (PVP K-90, 10% DMF solution produced by GAF) and 10 parts of novolak phenol resin (Resitop PSK-2320 produced by Gunei Chemical Co., 10% DMF solution) using a bar coater so that the dry film thickness was 6 mm, and then dried in a drying oven at 120° C. for 5 minutes. When an image was formed, transferred and fixed by the same method using the thus-formed resin film and a conventional resin film, the conventional resin film comprising a single PET layer had a sticky feeling on its surface after fixing and produced an image having poor transmission and a blackish or grayish projected image. The resin film of this embodiment had no sticky feeling caused by oil and produced an image having good transmission and a fixed color image having good colors developed.

EXAMPLE 2

A methyl ethyl ketone solution of epoxy resin having a solubility parameter value of 10.5 and a softening temperature of 100° C. was coated on a base material to form a topcoat layer 32 having a thickness of 10 μm after drying. A releasing agent absorbing layer A was formed by coating 100 parts of polyvinyl alcohol (PVA-117, 15% solution produced by Kuraray Co., Ltd.) by using a bar coater so that the dry thickness was 30 μm and then dried in a drying oven at 150° C. for 5 minutes. The thus-formed resin film was then used as a recording material and a good fixed image having no sticky feeding on the surface and good transmission and color development was obtained.

In this example, although the thickness of the releasing agent absorbing layer A was smaller than the average particle size of the toner, the toner was sufficiently compatible with the topcoat layer 32 due to the sufficient heat and pressure applied during fixing.

Examples of materials for the releasing agent absorbing layer A include natural resins such as albumin, gelatin, casein, starch, cationic starch, gum arabic, alginic soda and the like; synthetic resins such as carboxymethyl cellulose, hydroxyethyl cellulose, polyacrylic amide, polyethylene imide, quaternary polyvinyl pyrrolidone, polyvinyl pyridylium halide, melamine resins, phenolic resins, ion-modified polyvinyl alcohol, polyacrylic soda and the like; hydrophilic and water-insoluble polymer complexes preferably produced by cross-linking the polymers so as to make them water-insoluble and consisting of at least two hydrophilic polymers; hydrophilic and water-insoluble polymers each having hydrophilic segments and the like.

However, it is particularly effective to use a polyvinyl compound for silicone oil.

Various additives such as a waterproofing agent, a surfactant, a preservative, a mold control agent and the like can be added.

A preferable method of forming the releasing agent absorbing layer A on the base material comprises preparing a coating solution by dissolving or dispersing the above-described preferable materials in an appropriate solvent, coating the coating solution on the base material by a known method such as roll coating, rod bar coating, spray coating, air-knife coating or the like, and then rapidly drying the coated layer. A hot-melt coating method or a method of forming a single sheet using the above materials and then laminating the sheet on the base material may be used.

However, during the formation of the releasing agent absorbing layer A on the base material the adhesion between the base material and the releasing agent absorbing layer A is preferably improved by use of an anchor coat layer or the like so as to prevent the formation of a space therebetween.

EXAMPLE 3

In this example, the same resin film as that used in Example 1 was used, and the amount of the oil coated was decreased during fixing. Namely, 0.1 g./A4 of oil was coated in Example 1, while the amount of the oil coated was decreased to 0.02 g/A4 in Example 3. This was performed by changing (in this example, increasing) the contact pressure of the applying amount adjusting blade 40 with the roller 35.

As a result of fixing toner on a transfer material using the oil coated in the above amount, a fixed image having no sticky feeling and transmission better than that of the image formed in Example 1 could be obtained.

Such a decrease in amount of the oil coated had no influence on the durability of the fixing device.

EXAMPLE 4

Although the arrangement and materials of a base material and a resin layer were the same as those in Example 1, an oil absorbing layer A was formed by the method below. Inorganic fine particles of a compound consisting of aluminum as a main element was coated on the resin layer. The average pore diameter D of the fine particles was as follows:

$10 \leqq D \leqq 200$Å (angstrom).

At this time, the fine particles were coated so that the specific surface area of the resin film to which the fine particles were fixed was 0.1 to 30 $m^2/g$.

The fine particles can be coated by a generally known method such as a spray, a doctor blade, a knife coater, a bar coater, a wet method or the like.

The thus-formed resin film can be used as a good transfer material which forms an image having good transmission and which has oil absorptivity and a surface having no sticky feeling. The resin film can also be used as a good transparent recording material which is neither discolored nor deformed even if the heating amount is increased for melting the toner and resin used during fixing because the thermal stability is higher than PVA and PVP due to its higher heat resistance.

Although a compound consisting of aluminum as a main element is used as a material for the oil absorbing layer in Example 4, silica or the like can be used as the material within the range which enables transmission to be obtained. Further, other methods such as evaporation, mesh screen, printing methods and the like can be employed as the coating method.

EXAMPLE 5

In this example, 84 g./$m^2$ of paper (neutral paper) having a thickness of 80 μm was used as a base material. The same resin layer as that in Example 1 was coated in a thickness of 15 mm on the base material, and the same releasing agent absorbing layer A as that in Example 4 was coated as an upper layer on the resin layer.

When an image was formed and then fixed by the same method as that described above, the compatibility between the toner and the resin prevented irregular reflection and improved color development. In addition, the resin provided the mat paper surface with glossiness, and the glossiness of the paper surface was thus equal to that of the image portion, thereby producing uniform glossiness across the whole paper surface. The color image obtained was thus more desirable.

When a resin film had a resin layer on the surface thereof, although the oil coated as a releasing agent remained on the surface and gave a sticky feeling, the oil was absorbed by the releasing agent absorbing layer A provided without producing a sticky feeling on the surface. As result, a fixed image having good image texture could be obtained.

Although 84 g./$m^2$ of paper having a thickness of 80 μm was used as a base material in this example, paper having a thickness of 30 to 200 μm can be appropriately used in an amount of 10 to 300 g./$m^2$.

EXAMPLE 6

Figure 5:
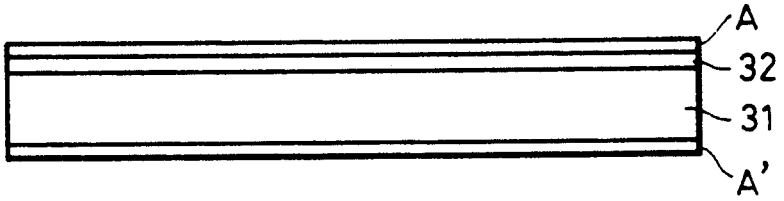
FIG. 5 is a sectional view of a recording material in accordance with another embodiment of the present invention.

A releasing agent absorbing layer A' of the same material as that of the releasing agent absorbing layer A was coated on the rear surface of a transfer material having the same structure as that in Example 4 (FIG. 5).

When an image was formed and fixed by the same method as that described above, the transfer material obtained had the same functions on the image surface as in Example 4 and both front and rear surfaces had good oil wetness and no sticky feeling because the oil adhering to the rear surface was also absorbed and removed by the absorbing layer A' formed on the rear surface.

EXAMPLE 7

Figure 6:
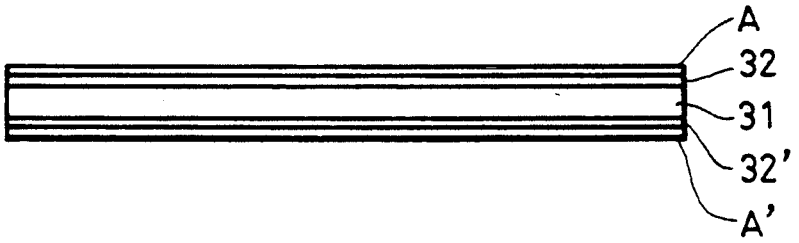
FIG. 6 is a sectional view of a recording material in accordance with still another embodiment of the present invention.

A topcoat layer 32 and a releasing agent absorbing layer A were formed on the same paper as that used in Example 5, and a topcoat layer 32' and a releasing agent absorbing layer A' were also formed on the rear side of the transfer material obtained (FIG. 6).

An image was formed and fixed to the front surface of the transfer material, and an image was then formed and fixed to the rear surface thereof. As a result, both the front and rear surfaces had no sticky feeling, and good images could be obtained on both the front and rear surfaces with uniform glossiness in the same way as in Example 5.

In the above-described examples in which an oil absorbing layer was provided on a resin layer having excellent compatibility with the toner used, a resin or Paper was used as a base material. However, a metal or the like can also be used as a base material.

Although the above-described examples concern the layer structure comprising a single releasing agent absorbing layer A and toner-compatible topcoat layer 32, the layer structure may comprise a plurality of releasing agent absorbing layers and toner-compatible topcoat layers. However, it is preferable from the viewpoint of ease of production that a single releasing agent absorbing layer and a single toner-compatible topcoat layer be used.

In addition, although the thickness of the releasing agent absorbing layer must be appropriately selected according to the type of the material used for the absorbing layer, the thickness is preferably less than the average particle size of the toner.

A description is now be made of examples in which a layer which absorbs oil to some extent is used as a resin layer with compatibility with the toner used.

EXAMPLE 8

Figure 7:
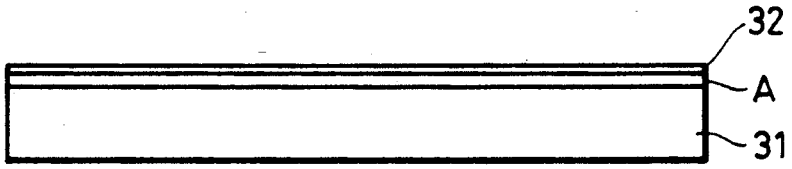
FIG. 7 is a sectional view of a recording material in accordance with a further embodiment of the present invention.

FIG. 7 is a sectional view showing a resin film of this example.

The layer structure comprising a resin base layer 31, a releasing agent absorbing layer A and a toner-compatible topcoat layer 32 was the same as that in Example 1.

In this example, the releasing agent absorbing layer A was provided on the resin base layer 31, and the toner-compatible topcoat layer 32 was provided as an upper layer on the releasing agent absorbing layer A.

In this example, the oil coated as a releasing agent produced no sticky feeling because the releasing agent coated was absorbed by the releasing agent absorbing layer A singularly or together with the molten resin on the surface layer and the toner resin laminated by image formation. The fixed image obtained had good transmission and good color development as a color image.

In the above Examples 2 to 7, the releasing agent absorbing layer A may be provided on the resin base layer 31, and the toner-compatible topcoat layer 32 may be provided on the absorbing layer A.

Figure 8:
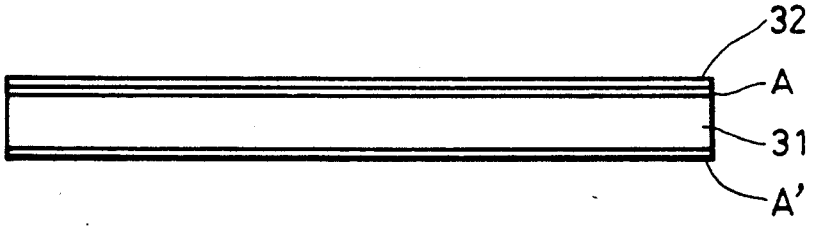
FIG. 8 is a sectional view of a recording material in accordance with a still further embodiment of the present invention.

FIGS. 8 and 9 shows examples in which the releasing agent absorbing layers A and the toner-compatible topcoat layers 32 of Examples 7 and 6, respectively, are reversed.

Although the above-described examples concern the case where the toner-compatible topcoat layer 32 and the releasing agent absorbing layer A are separately provided, an example in which a single layer having compatibility with the toner and releasing agent absorptivity is provided is described below.

EXAMPLE 9

Figure 10:
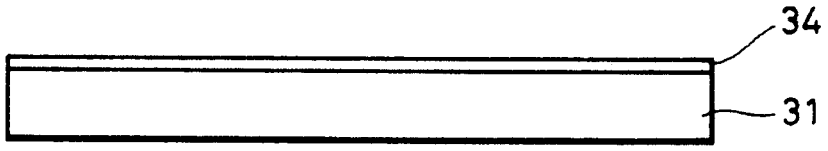
FIG. 10 is a sectional view of a recording material in accordance with a further embodiment of the present invention.

A combination releasing agent-absorbing and toner-compatible topcoat layer 34 was provided on the same resin base layer 31 as that used in Example 1 (FIG. 10).

In FIG. 10, reference numeral 34 denotes a topcoat layer comprising a transparent resin layer for improving light transmission of the color image fixed and for absorbing the releasing agent coated. It is preferable for improving the light transmission that the resin for forming the layer 34 is the same as the resin of the toner forming a color image or compatible with the toner resin and has a softening temperature ($T_0$) which is defined by the point C on the softening S-curve obtained by the flow tester CFT-500 (manufacture by Shimadzu Corp.) and which shows a temperature difference of 40° C. or less, preferably 20° C. or less, and more preferably 10° C. or less, from the softening temperature of the toner defined by the same method. The resin of the layer 34 in the fixed image is preferably substantially mixed with the toner resin without forming any boundary due to the compatibility with the binder resin of the toner. The resin of the layer 34 may be selected on the basis of the criterion that a difference between the solubility parameter values of the resin of the layer 32 and the binder resin of the toner is within the range of ±1.5 or less, preferably ±1.0 or less. The solubility parameters of resins are described in a publication such as the Polymer Handbook, as identified above, or the like. For example, when the above-described polyester resin is used as a binder resin of the toner, since the solubility parameter value is about 11.0, a resin having a difference in the softening temperature of ±40° C. from that of the binder resin may be selected from the group consisting of polyester resins, polymethylmethacrylate resins, epoxy resins, polyurethane resins, vinyl chloride resins, vinyl chloride-vinyl acetate copolymers and the like, all of which have a solubility value of about 11.0. The resin of the layer 34 more preferably both the above-described softening point and sharp melting properties.

Porous spherical silica particles were dispersed in the resin so as to absorb silicone oil.

A solution obtained by dissolving in acetone a sharp melting polyester resin (solubility parameter about 11.0) having a softening point of 110° C. which was defined by the point C on the softening S-curve obtained by the flow tester CFT-500 (manufactured by Shimadzu Corp.) and then dispersing silica particles in the acetone solution was coated, by the bar coater method, on a biaxially oriented heat-resistant polyethylene terephthalate film having a thickness of 100 μm and a highest use temperature of 150° C. A topcoat layer was formed so that the dry thickness was 16 μm to obtain a transparent film.

In this example, the weight ratio between the resin and the silica spherical particles was 1:4.

When an image was formed, transferred and fixed using the thus-obtained recording material, the compatibility between the toner and the resin prevented the formation of boundaries and thus improved light transmission, and the oil coating produced no sticky feeling because the oil was absorbed during fixing by the releasing agent absorbing substance (in this example, spherical silica particles) contained in the resin molten. A fixed image having good transmission and good color development as a color image was obtained.

Although the thickness of the layer 34 depends upon the particle size of the toner used, the thickness must be a value of at least half of the average toner particle in order to cause a low-density portion having a thickness corresponding to a single toner particle size to transmit light. However, if the thickness is three times or more the toner particle size, the amount of molten resin is increased, and blurring or distortion occurs in the image formed.

The method of measuring the average toner particle size is the same as that described above.

The film of this example is produced by a method in which a releasing agent absorbing resin is dissolved in a volatile organic solvent. Solvents that may be used include an alcohol such as methanol, ethanol or the like or a ketone such as methyl ethyl ketone, acetone or the like. The dissolved releasing agent absorbing resin is coated on the above-described transparent base film by a bar coating method, a dipping method, a spray method, a spin-coating method or the like, and then dried. In some cases, an adhesive layer having compatibility with both the base film 31 and the topcoat layer resin 32 and high heat resistance, which prevents the layer from becoming molten during fixing, may be provided for improving the adhesion between the topcoat layer 32 and the base film 31 and preventing the image formed from being separated during and after fixing. Examples of resins that can be used for the adhesive layer include ester resins, acrylate resins, methacrylate resins, styrene-acrylate copolymers, styrene-methacrylate copolymers and the like.

In addition, other silica materials can be used as the releasing agent absorbing substance.

Further, the mixing ratio between the resin and the releasing agent absorbing substance can be appropriately selected.

When an image was formed and fixed to the resin film of this example, even if the amount of the oil coated was decreased to 0.02 g./A4, no oil sticky feeling occurred, and a fixed image having good transmission could be obtained.

Such a decrease in amount of the oil coated had no influence on the durability of the fixing device.

EXAMPLE 10

Although the arrangement and materials of the base and resin layers were the same as those in Example 9, a combination releasing agent-absorbing and toner-compatible resin layer 34 was formed by the method below.

In this example, fine particles of an inorganic compound consisting of aluminum as a main element were dispersed as a releasing agent absorbing substance in the resin and coated by the same method as that employed in Example 9. The average pore diameter D of the inorganic fine particles was as follows:

$10 \leqq D \leqq 200$Å (angstrom)

A spray method, a doctor blade method, a knife coater method, a bar coater method, a wet method, an evaporation method, a printing method or the like can be used as the coating method in the same way as that in Example 9.

The thus-obtained recording material produces an image having good transmission and has oil absorptivity and no sticky feeling on the surface thereof, like Example 9. In addition, since the heat stability of the recording material is increased due to its high heat resistance, the recording material is neither discolored nor deformed during the fixing operation, even if the heating amount is increased for melting the toner and resin.

Paper can be used as the base material in the same way as in Examples 5 and 6.

EXAMPLE 11

Figure 11:
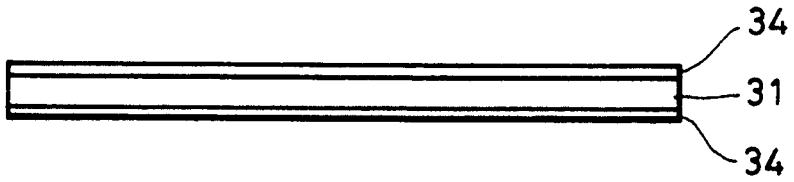
FIG. 11 is a sectional view of a recording material in accordance with a still further embodiment of the present invention.

In the example shown in FIG. 11, a combination releasing agent-absorbing and toner-compatible resin layer 34 is provided on either side of a base layer 31.

An image was formed and fixed to the recording material obtained, and an image was then formed and fixed to the rear surface thereof. As a result, a good image could be either side of the recording material without oil sticky feeling and difference in glossiness.

In this example, a metal or the like can also be used as the base material.

Although, in the above-described examples, the amount of the oil coated is 0.2 g./4A or 0.1 g./4A, the present invention can be achieved with an application of 0.001 to 0.5 g./4A.

If the amount of the oil coated is 0.001 g./4A or less, no oil sticky feeling essentially occurs, while if the amount exceeds 0.5 g./4A, the thickness of the absorbing layer is undesirably increased.

Although dimethylsilicone oil is described above as an example of types of oil, any types of releasing agents such as phenylsilicone oil, fluorine oil, amino-modified silicone oil and the like can be used in the invention.

In addition, although PRT is used as the resin base material, other resins such as polyester, polystyrene and the like can be used.

While the present invention has been described with respect to what is presently considered to be preferred embodiments, it is to be understood that the invention is not limited to the disclosed embodiments. The present invention is intended to cover various modifications and equivalent arrangements included within the spirit and scope of the appended claims.

What is claimed is:

1. A recording material for use in an image forming apparatus in which an image made of melting powder toner is formed on a recording material and then fixed by application of heat and pressure from a heating rotatable member that is coated with a releasing oil, said recording material comprising:

a base resin layer;

a first resin layer provided on said base resin layer, having a lower softening temperature than that of said base resin layer and a compatibility of solubility with the powder toner by application of the heat greater than with said base resin layer; and a second resin layer provided on said first resin layer for absorbing a releasing oil.

2. A recording material according to claim 1, wherein the thickness of said second resin layer is less than the average particle size of the toner.

3. A recording material according to claim 1, wherein said second resin layer is made of a polyvinyl compound.

4. A recording material according to claim 1, wherein said releasing oil is silicone oil.

5. A recording material according to claim 1, wherein said base layer is thicker than said first resin layer and said second resin layer.

6. A recording material according to claim 1, wherein said base layer is made of a resin.

7. A recording material for use in an image forming apparatus in which an image made of melting powder toner is formed on a recording material and then fixed by application of heat and pressure from a heating rotatable member that is coated with a releasing oil, said recording material comprising:

a base resin layer;

a first resin layer having a lower softening temperature than that of said base resin layer and a compatibility of solubility with the powder toner by application of the heat greater than with said base resin layer; and a second resin layer for absorbing the releasing oil, wherein said second resin layer is provided on said base resin layer and said first resin layer is provided on said second resin layer.

8. A recording material according to claim 7, wherein the thickness of said second resin layer is less than the average particle size of the toner.

9. A recording material according to claim 7, wherein said second resin layer is made of a polyvinyl compound.

10. A recording material according to claim 7, wherein said releasing agent is silicone oil.

11. A recording material according to claim 7, wherein said base layer is thicker than said first resin layer and said second resin layer.

12. A recording material according to claim 7, wherein said base layer is made of a resin.

13. A recording material for use in an image forming apparatus in which an image made of melting powder toner is formed on a recording material and then fixed by application of heat and pressure from a heating rotatable member that is coated with a releasing oil, said recording material comprising:

a base layer; and a resin layer having a lower softening temperature than that of said base layer and a compatibility of solubility with the powder toner by application of the heat greater than with said base layer and containing a releasing oil absorbing substance.

14. A recording material according to claim 13, wherein said releasing agent absorbing substance is silica.

15. A recording material according to claim 13, wherein said releasing agent absorbing substance is alumina.

16. A recording material according to claim 13, wherein said resin material is made of a polyvinyl compound.

17. A recording material according to claim 13, wherein said releasing oil is silicone oil.

18. A recording material according to claim 13, wherein said resin layer is thinner than said base layer.

19. A recording material according to claim 13, wherein said base layer comprises a resin.

* * * * *

UNITED STATES PATENT AND TRADEMARK OFFICE

CERTIFICATE OF CORRECTION

PATENT NO. : 5,289,245
DATED : February 22, 1994
INVENTOR(S) : TAKESHI MENJO

It is certified that error appears in the above-indentified patent and that said Letters Patent is hereby corrected as shown below:

Column 2,
Line 32, "an" should read --and--.

Column 5,
Line 62, "ature 70°C." should read --ature of 70°C--.

Column 6,
Line 15, "103" should read --$10^3$--; and
Line 37, "HTv" should read --HTV--.

Column 9,
Line 13, "extrapure" should read --extra pure--; and
Line 14, "alkylbensenesul-" should read --alkylbenzenesul--.

Column 10,
Line 28, "feeding" should read --feeling--.

Signed and Sealed this

Sixth Day of September, 1994

*Attest:*

*Attesting Officer*

BRUCE LEHMAN

*Commissioner of Patents and Trademarks*